US007686161B2

(12) United States Patent
Simmons

(10) Patent No.: US 7,686,161 B2
(45) Date of Patent: Mar. 30, 2010

(54) CONTAINMENT ARTICLE HAVING A PERSONAL HYGIENE ARTICLE IN COMBINATION THEREWITH

(76) Inventor: David Odell Simmons, 7637 Parkview Cir., Austin, TX (US) 78731

( * ) Notice: Subject to any disclaimer, the term of this patent is extended or adjusted under 35 U.S.C. 154(b) by 0 days.

(21) Appl. No.: 12/228,144

(22) Filed: Aug. 8, 2008

(65) Prior Publication Data

US 2009/0159468 A1 Jun. 25, 2009

Related U.S. Application Data

(63) Continuation of application No. 11/185,408, filed on Jul. 20, 2005, now Pat. No. 7,426,994.

(51) Int. Cl.
*B65D 77/04* (2006.01)

(52) U.S. Cl. ..... 206/217; 206/494; 206/812

(58) Field of Classification Search ..... 206/205, 206/210, 217, 218, 223, 229, 233, 494, 812; 215/6, 386, 387; 426/115, 124
See application file for complete search history.

(56) References Cited

U.S. PATENT DOCUMENTS

| | | | | |
|---|---|---|---|---|
| 1,879,517 | A * | 9/1932 | Rowbotham | 206/232 |
| 2,292,413 | A * | 8/1942 | Taylor | 206/229 |
| 3,920,120 | A * | 11/1975 | Shveda | 206/217 |
| 4,033,453 | A * | 7/1977 | Giaimo | 206/217 |
| 4,651,890 | A * | 3/1987 | Coker et al. | 215/6 |
| 5,996,169 | A * | 12/1999 | Cooper | 15/257.01 |
| 2002/0043473 | A1 * | 4/2002 | Lee et al. | 206/217 |

* cited by examiner

*Primary Examiner*—Luan K Bui

(57) ABSTRACT

A personal hygiene article comprises an individually packaged sanitizing wipe, a second package, a graspable member and means for attaching the second package to a different article. The individually packaged sanitizing wipe includes a first package having a sanitizing wipe contained therein. The second package has the individually packaged sanitizing wipe contained therein. The graspable member is attached to a surface of the package in a manner enabling grasping and pulling of the graspable member to at least one of open the package and detach the package from the different article. The means for attaching the second package to a different article is attached to the second package.

16 Claims, 6 Drawing Sheets

CONTAINMENT ARTICLE HAVING A PERSONAL HYGIENE ARTICLE IN COMBINATION THEREWITH

CROSS REFERENCE TO RELATED APPLICATIONS

This patent application is a Continuation patent application claiming priority from United States Non-provisional patent application having Ser. No. 11/185,408 filed Jul. 20, 2005, now U.S. Pat. No. 7,426,994 entitled "Individually Packaged Sanitizing Wipe And Articles Comprising Same" and having a common applicant herewith, which is incorporated herein in its entirety by reference.

FIELD OF THE DISCLOSURE

The present invention relates generally to personal hygiene and health and, more particularly, to individually packaged sanitizing wipes.

BACKGROUND

Personal hygiene and health are directly influenced by cleanliness of a person's hands. On a daily basis, people exchange germs and bacteria via their hands. Through acts that people conduct on a daily basis such as touching door handle, a handrail, a keyboard, and like, they are transferring germs and bacteria. Even worse, when eating food with their hands after exposure to gems and bacteria in this manner, they are ingesting some of those germs. In many cases, those germs and bacteria may lead to short or long term health issues. Accordingly, it is advantageous for the general public to practice good personal hygiene by keeping their hands clean.

When convenient and practical, washing one's hands is a simple and effective way to keep their hands clean. However, in many instances, washing their hands is inconvenient and impractical. For this reason, many people do not clean their hands before and after meals at restaurants, when picnicking, camping, during lunch meeting and the like. Unfortunately, the locations in and circumstances under which these types of activities are conducted are exactly those that can lead to contamination of food and body.

Individually packaged sanitizing wipes (commonly referred to as hand wipes) are known and commercially available from a number of manufacturers. Examples of manufacturers through which such conventional individually packaged sanitizing wipes are commercially available include GoJo Industries Incorporated (Purell brand), Platex Products Incorporated (Wet Ones brand) and Royal Paper Products Incorporated (Royal Line Fingerbowl brand). Such individually packaged sanitizing hand wipes generally have one or, at most, a few wipes in a small package (e.g., the size of a matchbook). They provide a very effective means of cleaning one's hands in situations where it might otherwise be inconvenient and impractical. They are also relatively inexpensive, small and easy to carry and provide sufficient sanitizing (e.g., killing of germs and bacteria) action.

Even as convenient, effective and inexpensive as individually packaged sanitizing wipes are, they are still not used on a widespread basis. For example, one would think that their distribution and use in fast-foot restaurants would dramatically reduce the spread and ingestion of germs and bacteria. It is believe that two major drawbacks to their widespread use is that they are not suitably configured for being distributed in a high-profile manner and in a point-of-use manner.

Therefore, an individually packaged sanitizing wipe that is configured in a manner for enabling it to at least partially overcome limitations and drawbacks associated with conventional sanitizing wipes and their limited use would be useful and novel.

SUMMARY OF THE DISCLOSURE

In one embodiment, a personal hygiene article comprises an individually packaged sanitizing wipe including a first package having a sanitizing wipe contained therein. A second package has the individually packaged sanitizing wipe contained therein. A graspable member is attached to a surface of the second package.

In another embodiment, a containment article comprises a container body and an individually packaged sanitizing wipe. The container body includes a first open end, a second open end, a side wall and a bottom wall. A major cavity is defined between the first open end, the side wall and the bottom wall. A minor cavity is defined between second open end, the side wall and the bottom wall. The individually packaged sanitizing wipe is contained within the minor cavity.

In another embodiment, an individually packaged sanitizing wipe comprises a sanitizing wipe, a package having the sanitizing wipe contained therein, means for attaching the package to a different article and a graspable member attached to a surface of the package. The means for attaching the package to a different article is attached to the package. The graspable member is attached to a surface of the package in a manner enabling grasping and pulling of the graspable member to at least one of open the package and detach the package from the different article.

Embodiments of the present invention provide a convenient and useful means for enabling a person to clean their hands prior to consuming food. More specifically, individually packaged sanitizing wipes and articles in accordance with embodiments of the disclosures made herein enable individually packaged sanitizing hand wipes to be distributed in a convenient, high-profile and/or point-of-use manner. Accordingly, individually packaged sanitizing wipes and articles in accordance with embodiments of the disclosures made herein advantageously promote personal hygiene and health by providing a convenient, high-profile and/or point-of-use means for sanitizing portions of one's body (e.g., their hands). Accordingly, it is a principal object of the present invention to provide that at least partially overcomes limitations associated with conventional approaches for distributing individually packaged sanitizing wipes.

Turning now to specific embodiments of the present invention, in at least one embodiment of the present invention, the second package includes a first layer of material and a second layer of material.

In at least one embodiment of the present invention, a perimeter region of the first layer of material comprised by the graspable member is attached to perimeter region of the second layer of material thereby providing a pouch having the individually packaged sanitizing wipe contained therein.

In at least one embodiment of the present invention, the graspable member includes a first portion attached to a surface of a package associated with an individually packaged sanitizing wipe and a second portion that is graspable.

In at least one embodiment of the present invention, the graspable member is attached to the surface of a respective package in a manner enabling grasping and pulling of the graspable member to at least one of open the respective package and detach the respective package from a different article to which the respective package is attached.

In at least one embodiment of the present invention, a package having an individually package sanitizing wipe contained therein is configured for being attached to the bottom of a container and the package is configured for defining a support surface of a container when attached thereto.

In at least one embodiment of the present invention, a layer of material extends over the individually package sanitizing wipe for containing the individually package sanitizing wipe within a cavity of a container body and is attached to at least one of the bottom wall, the side wall and a bottom edge of the container body.

In at least one embodiment of the present invention, the graspable member is attached to a layer of material that extends over an individually packaged sanitizing wipe for containing the individually packaged sanitizing wipe within a cavity of the container body and enables the layer of material to be at least one of breached or released for permitting access to the individually packaged sanitizing wipe.

These and other objects and embodiments of the present invention will become readily apparent upon further review of the following specification and associated drawings.

DETAILED DESCRIPTION OF THE DRAWINGS

Figure 1:
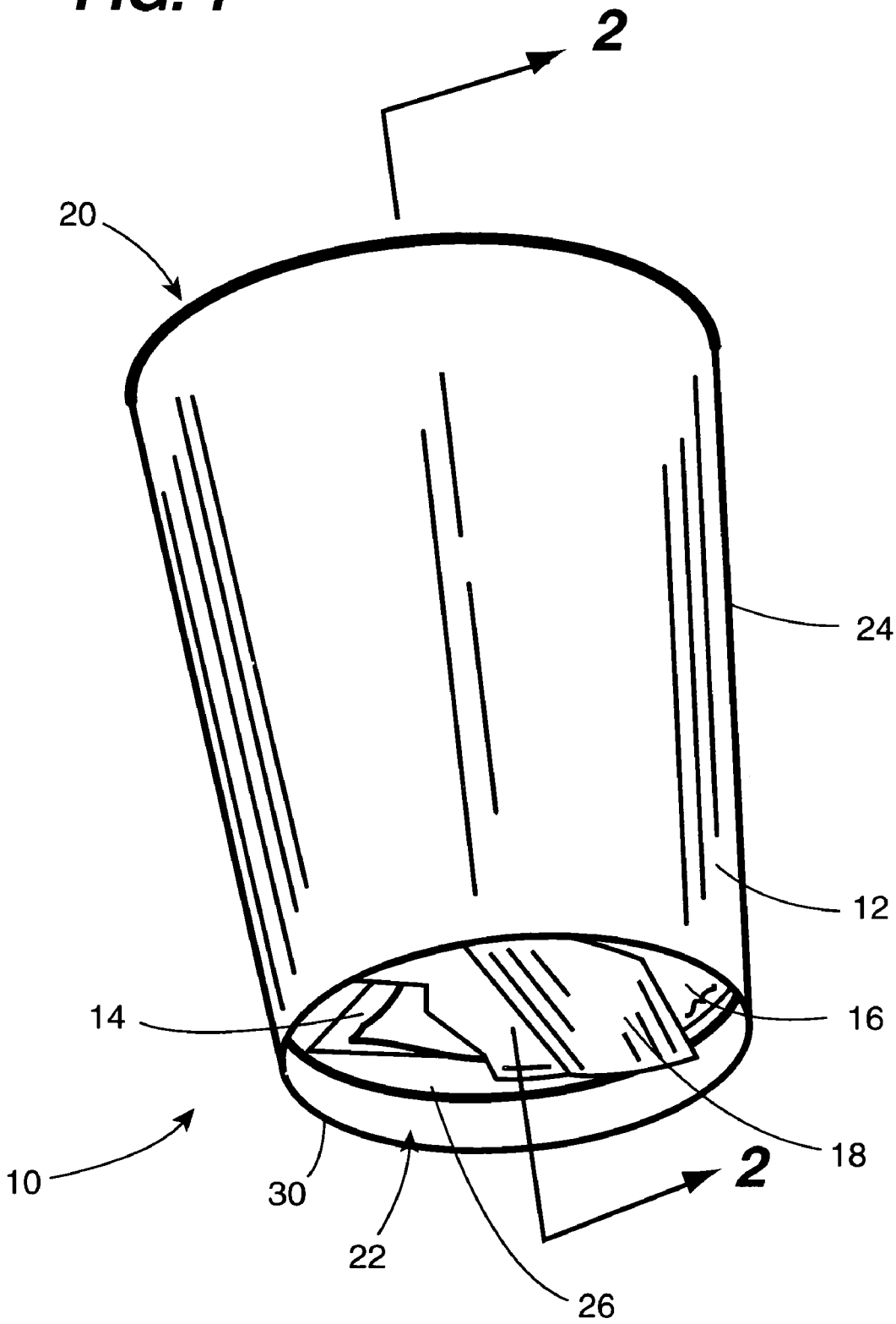
FIG. 1 depicts a containment article having a sanitary wipe arrangement in accordance with a first embodiment of the present invention.
Figure 2:
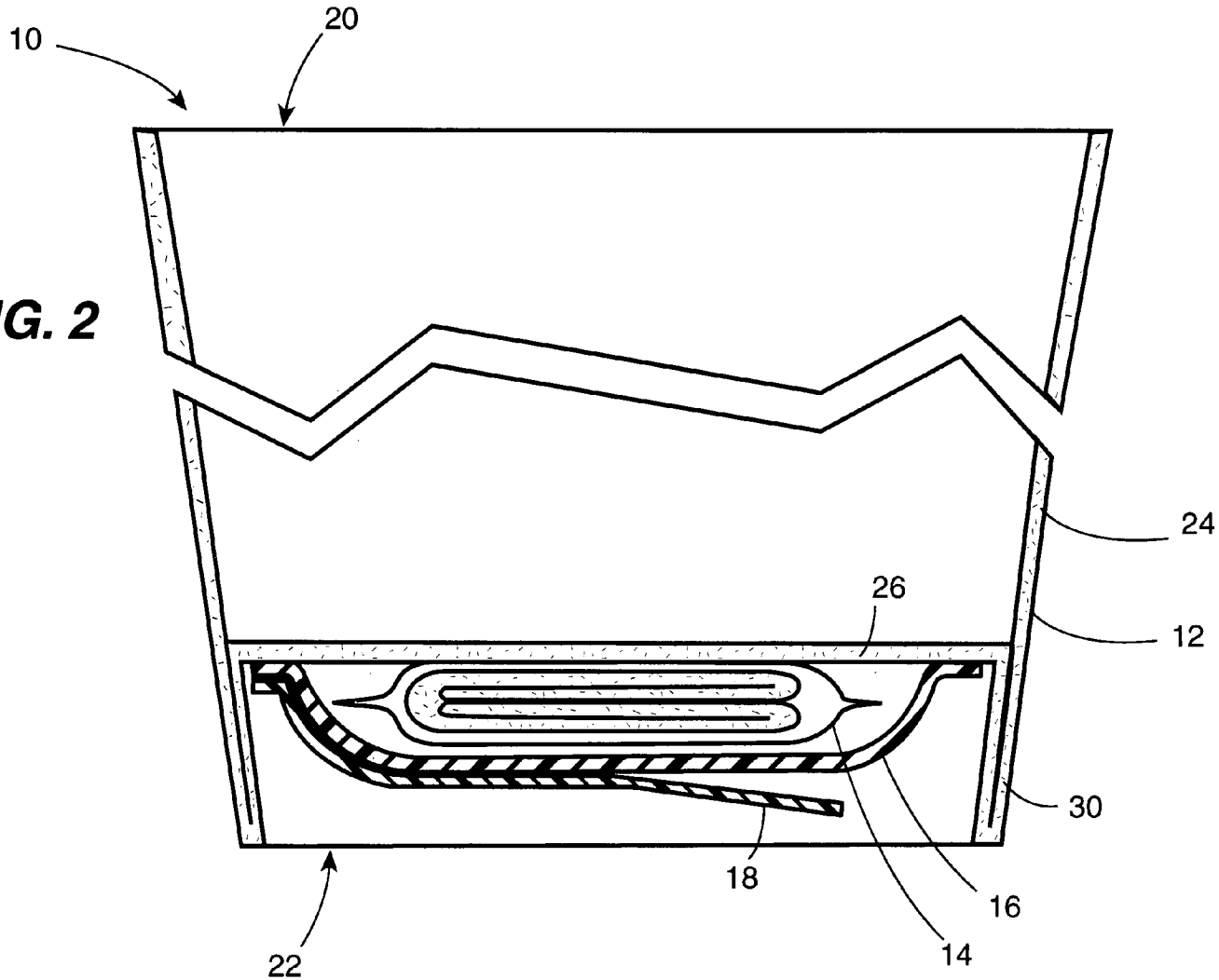
FIG. 2 is a cross sectional view taken along the line 2-2 in FIG. 1.

FIGS. 1 and 2 depict an embodiment of a containment article 10 configured in accordance with the present invention. The containment article 10 includes a container body 12, an individually packaged sanitizing wipe 14, a layer of material 16 and a graspable member 18. The container body 12 including a first open end 20, a second open end 22, a side wall 24 and a bottom wall 26. A major cavity is defined between the first open end 20, the side wall 24 and the bottom wall 26. A minor cavity is defined between second open end 22, the side wall 24 and the bottom wall 26. In one embodiment, the container body 12 is a cup-shaped container body configured for having a liquid disposed in the major cavity.

A layer of material 16 contains the individually packaged sanitizing wipe 14 within the minor cavity. The layer of material 16 extends over the individually package sanitizing wipe 14 and is attached to the bottom wall 26. It is contemplated herein that the layer of material 16 may be attached additionally or optionally to the side wall 24 and/or a bottom edge 30 of the container body 12. Accordingly, the layer of material 16 contains the individually packaged sanitizing wipe 14 within the minor cavity. A polymeric film and a metallic film are examples of the layer of material 24, which is a means for containing the individually packaged sanitizing wipe 14 within the minor cavity.

The graspable member 18 is attached to the layer of material 16 in a manner enabling the layer of material 16 to be breached or released for permitting access to the individually packaged sanitizing wipe 14. Preferably, the graspable member 18 includes a first portion with a surface attached to a surface of the layer of material 16 and a second portion that is graspable. In use, a user would grasp and pull the graspable member 14 while holding the container body 12. In doing so, the layer of material would be breached or released from the container body 12 thus allowing access to the individually packaged sanitizing wipe 14.

Figure 3:
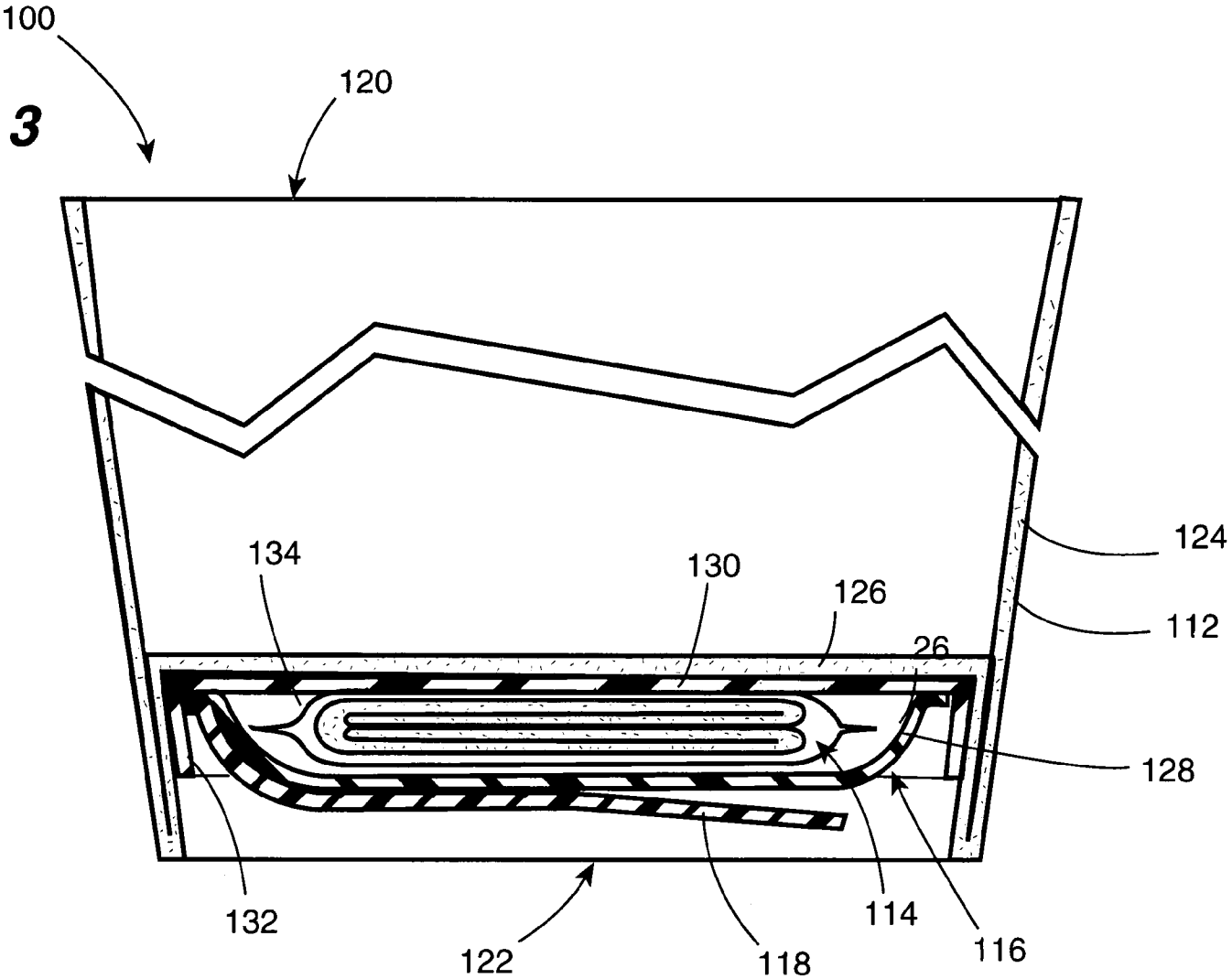
FIG. 3 depicts a containment article having a sanitary wipe arrangement in accordance with a second embodiment of the present invention.

FIG. 3 depicts a second embodiment of a containment article 100 configured in accordance with the present invention. The containment article 100 includes a container body 112, an individually packaged sanitizing wipe 114, an outer package 116 having the individually packaged sanitizing wipe contained therein and a graspable member 118. The container body 112 including a first open end 120, a second open end 122, a side wall 124 and a bottom wall 126. A major cavity is defined between the first open end 120, the side wall 124 and the bottom wall 126. A minor cavity is defined between second open end 122, the side wall 124 and the bottom wall 126. In one embodiment, the container body 112 is a cup-shaped container body configured for having a liquid disposed in the major cavity.

The outer package 116 includes a first enclosure portion 128 and a mating second enclosure member 130. The first enclosure portion 128 and the mating second enclosure member 130 jointly define a cavity in which the individually packaged sanitizing wipe 114 is disposed. A polymeric film and a metallic film are examples of materials from which the first enclosure portion 128 and the mating second enclosure member 130 may be constructed.

As depicted, the outer package 116 includes a resilient member 132 that securely engages the side wall 124. The resilient flange is compressible and/or deflectable for exerting a retaining force when urged into the minor cavity. In this manner, the outer package is securely engaged with the container body 112 within the minor cavity in a manner that limits the potential for unintentional separation of the outer package from the container body 112. Accordingly, the outer package contains the individually packaged sanitizing wipe 14 within the minor cavity. The resilient member 132 is an example of a means for securing the individually packaged sanitizing wipe 14 to the container body 112 within the minor cavity.

The graspable member 118 is attached to the first enclosure portion 128 in a manner facilitating the first enclosure portion 128 to be breached or released from the mating second enclosure portion 130 for permitting access to the individually packaged sanitizing wipe 114 or facilitating disengagement of the outer package 116 from the container body 112. Preferably, the graspable member 118 includes a first portion with a surface attached to a surface of the first enclosure portion 128 and a second portion that is graspable. In use, a user would grasp and pull the graspable member 114 while holding the container body 112. In doing so, the first enclosure portion 128 would be breached or released from the mating second enclosure portion 130 or the outer package 116 would be disengaged from the container body 112, thus allowing access to the individually packaged sanitizing wipe 114.

In one embodiment, the first enclosure portion 128 and the mating second enclosure member 130 are adjoined by known means (e.g., heat staking, thermal sealing, ultrasonic welding, adhesive, etc.). In the case wherein an-air-tight interface is provided between the first enclosure portion 128 and the mating second enclosure member 130, it is contemplated that an inner package 134 of the individually packaged sanitizing wipe 114 may be omitted.

Figure 4:
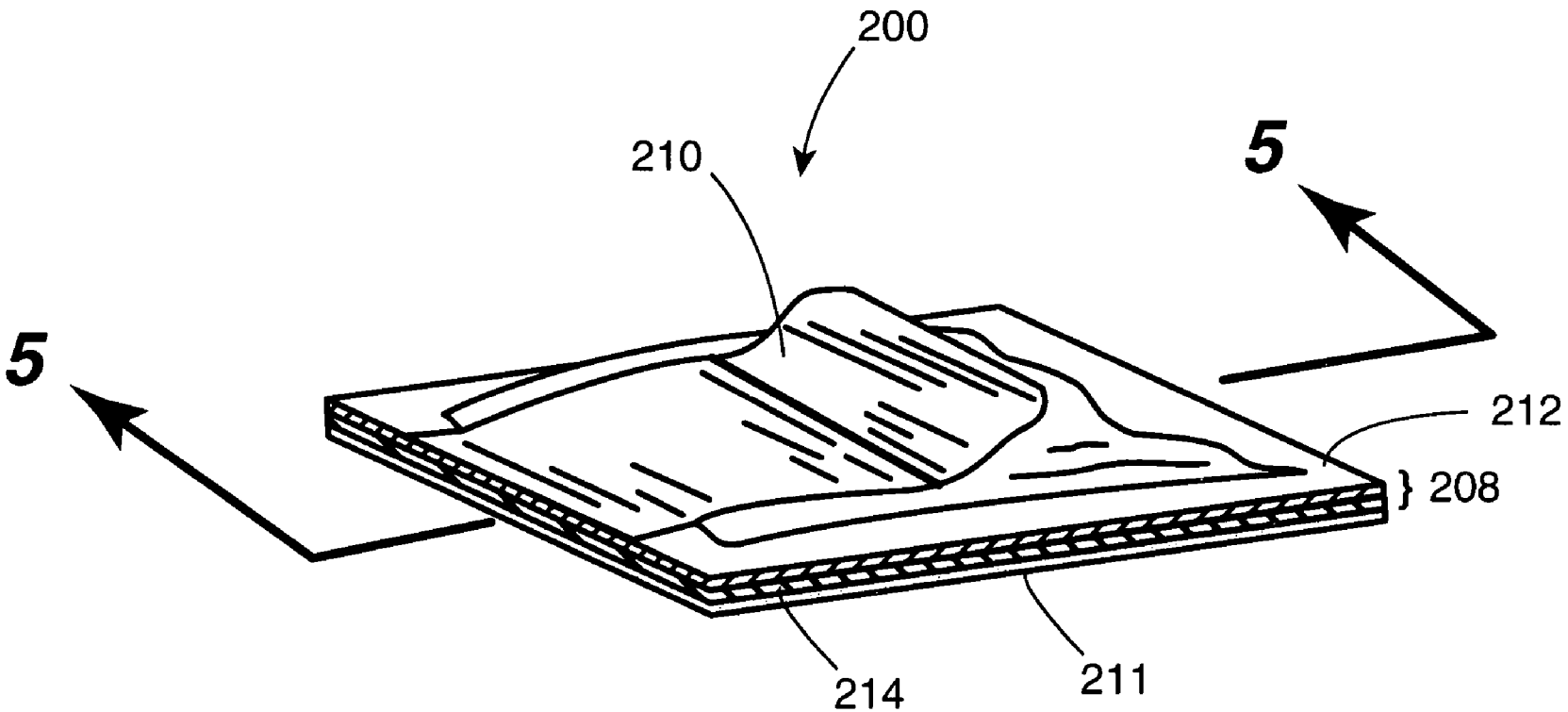
FIG. 4 depicts a first embodiment of a personal hygiene article configured in accordance with the present invention.
Figure 5:
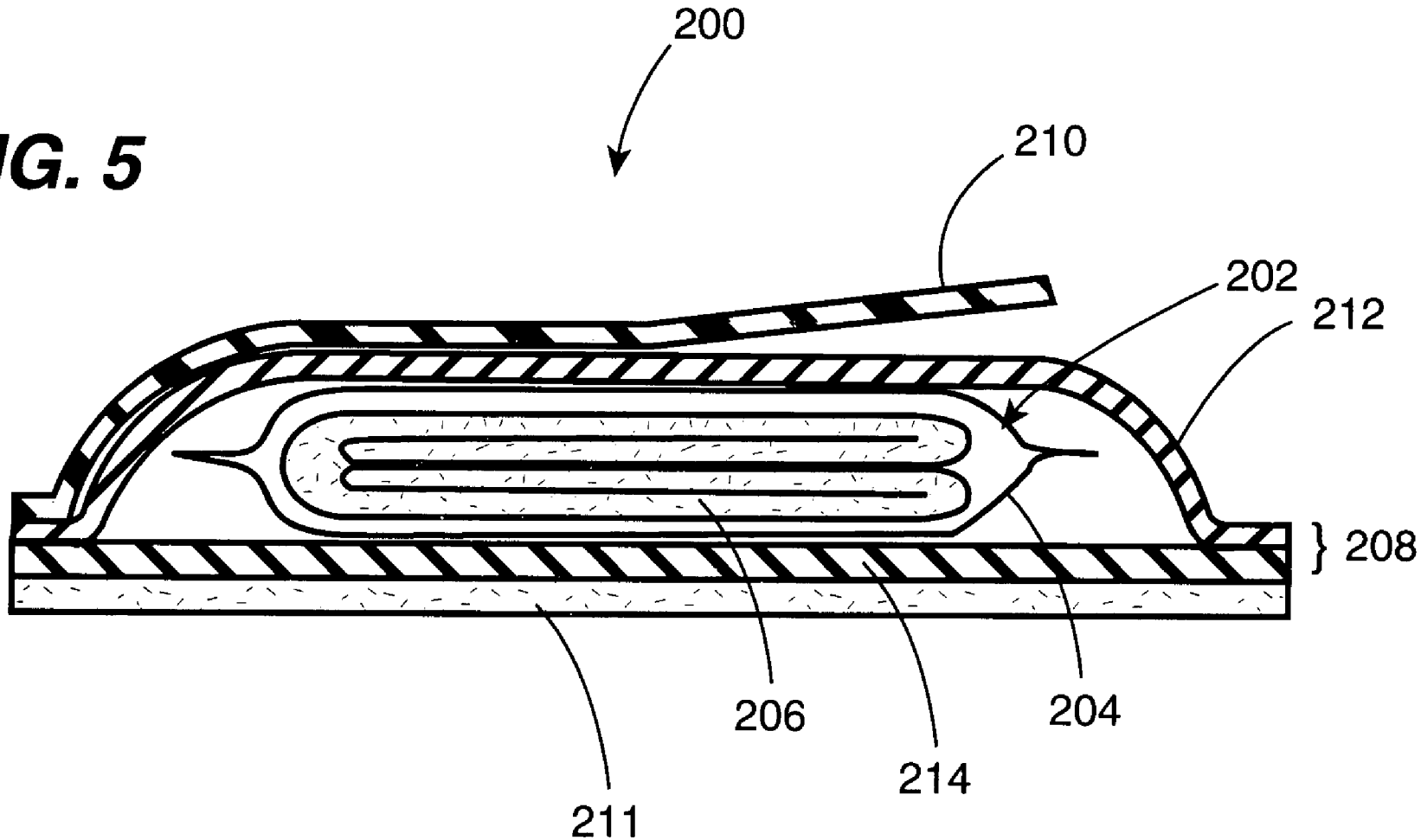
FIG. 5 is a cross sectional view taken along the line 5-5 in FIG. 4.

FIGS. 4 and 5 depict an embodiment of a personal hygiene article 200 in accordance with the present invention. The personal hygiene article 200 includes an individually packaged sanitizing wipe 202 including a first package 204 having a sanitizing wipe 206 contained therein (e.g., configured in accordance with a commercially available individually packaged sanitizing wipe). The personal hygiene article 200 further includes a second package 208, a graspable member 210 and means 211 for attaching the second package 208 to a different article (e.g., to the bottom wall of a container). The means 211 for attaching the second package 208 to a different article is attached to the second package 208. A layer of adhesive and a heat bondable material are examples of the means 211 for attaching the second package 208.

The second package 208 has the individually packaged sanitizing wipe 204 contained therein. The graspable member 210 is attached to a surface of the second package 208. Preferably, the graspable member 118 includes a first portion attached to a surface of the second package 208 and a second portion that is graspable.

The second package 208 includes a first layer of material 212 and a second layer of material 214. A perimeter region of the first layer of material 212 is attached to perimeter region of the second layer of material 214. In this manner, a pouch having the individually packaged sanitizing wipe contained therein is provided.

It is contemplated herein that, in the case were the second package 208 of the personal hygiene article 200 is air-tight, the first package 204 may be omitted.

Figure 6:
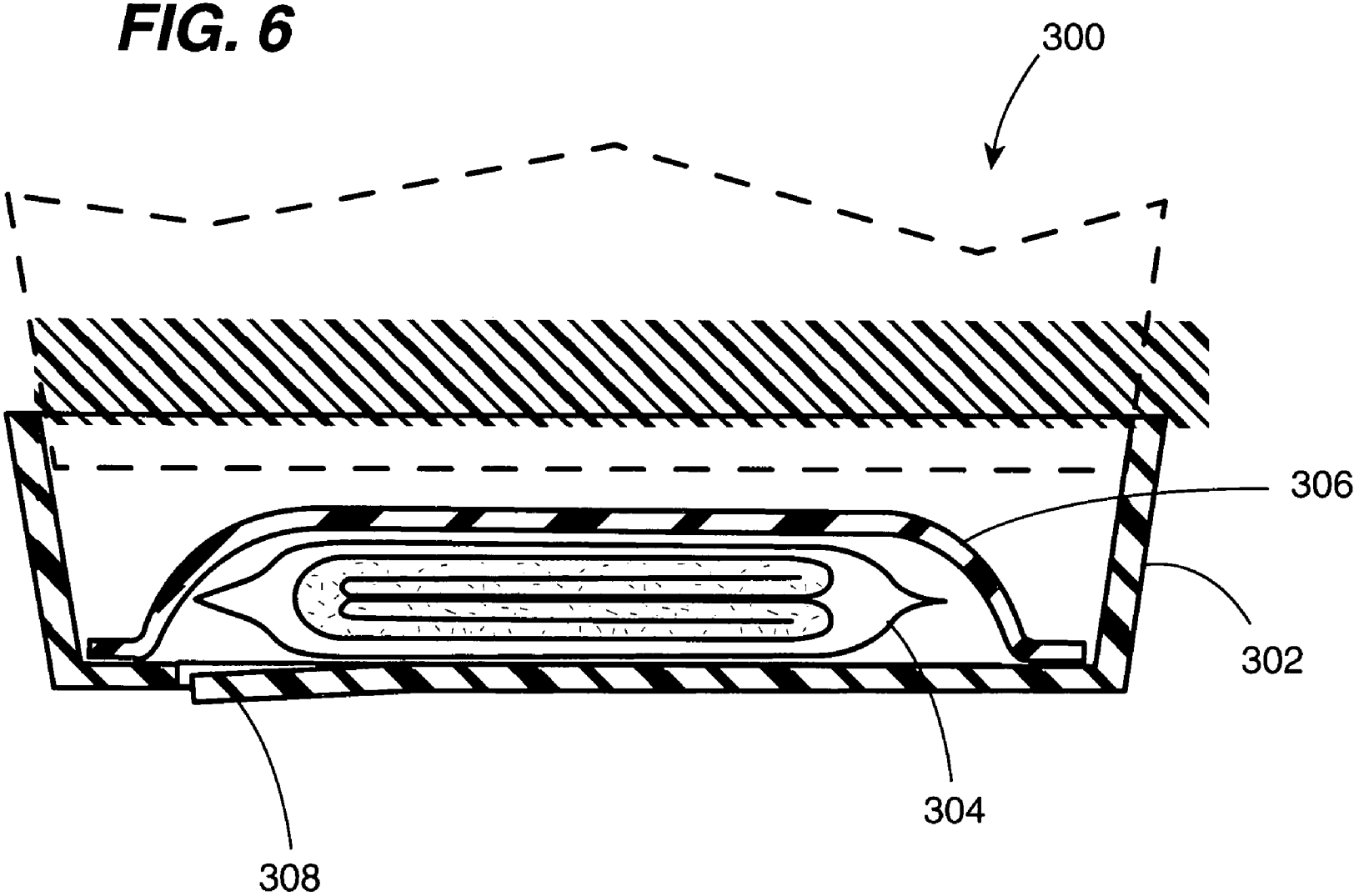
FIG. 6 depicts a second embodiment of a personal hygiene article configured in accordance with the present invention.

FIG. 6 depicts a personal hygiene article 300 configured for being attached to a container. Preferably, the personal hygiene article 300 is configured for being attached to the bottom portion of a cup that does not have a minor cavity as does the container depicted above in FIGS. 1 and 2. In such preferred configurations, the personal hygiene article 300 is further configured for defining a support surface of the container when the personal hygiene article is attached to the container.

The personal hygiene article 300 includes a mounting member 302, an individually packaged sanitizing wipe 304 and an enclosure member 306. The enclosure member 306 is mounted on (e.g., engaged with or attached to) the mounting member 302 for defining a cavity in which the individually packaged sanitizing wipe 304 is disposed. The mounting member 302 includes a grasping member 308 attached to (e.g., formed integrally therewith) and are an embodiment of a second package in accordance with the present invention. The mounting member 302 and the grasping member 308 are jointly configured in a manner enabling the mounting member to be breached whereby an access opening is formed in the mounting member 302 through which the individually packaged sanitizing wipe 304.

Although not specifically shown, it is contemplated herein that the personal hygiene article 300 may be configured with a means for attaching the mounting member second package to a container (i.e., a different article). For example, regions may be provided on the mounting member 302 for facilitating heat stacking of the mounting member 302 to the container. Alternately, a mechanical attachment means may be configured for being engaged with a mating portion of the container.

Advantageously, certain embodiments of individually packaged sanitizing wipes in accordance with the present invention are manufactured in a manner that enables their integration into the manufacture of a subsequent product. For example, the individually packaged sanitizing wipes are manufactured by a company specializing in manufacturing individually packaged sanitizing wipes and are subsequently used as an input material by a cup manufacturer. In this manner, required alterations to a particular manufacturing operation are minimized.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A containment article, comprising:

a container body including a first open end, a second open end, a side wall and a flat bottom wall, wherein a major cavity is defined between the first open end, the side wall and the bottom wall and a minor cavity is defined between the second open end, the side wall and the bottom wall;

a packaged sanitizing wipe disposed within the minor cavity of the container body, wherein the packaged sanitizing wipe includes a package having a sanitizing wipe contained within an interior space thereof;

a layer of material extending over the packaged sanitizing wipe and being attached to the container body such that the layer of material contains the packaged sanitizing wipe within the minor cavity; and a graspable member integral with the layer of material, wherein the graspable member and the package are jointly configured for allowing the layer of material to be at least one of breached and released for permitting access to the packaged sanitizing wipe.

2. The containment article of claim 1 wherein the layer of material is attached to the bottom wall of the container body.

3. The containment article of claim 2 wherein the layer of material is conformable such that the layer of material at least partially conforms to a shape of the packaged sanitizing wipe.

4. The containment article of claim 3 wherein the layer of material is attached only to the bottom wall of the container body.

5. The containment article of claim 1 wherein the container body is a cup configured for having a liquid disposed in the major cavity.

6. The containment article of claim wherein:

the layer of material is attached to the bottom wall of the container body; and the layer of material is conformable such that said material at least partially conforms to a shape of the packaged sanitizing wipe.

7. A containment article, comprising:

a container body including a first open end, a second open end, a side wall and a bottom wall, wherein a major cavity is defined between the first open end, the side wall and the bottom wall and a minor cavity is defined between the second open end, the side wall and the bottom wall;

a packaged sanitizing wipe disposed within the minor cavity of the container body, wherein the packaged sanitizing wipe includes a package having a sanitizing wipe contained within an interior space thereof;

a layer of material extending over the packaged sanitizing wipe and being attached to the bottom wall of the container body such that the layer of material contains the packaged sanitizing wipe within the minor cavity, wherein the layer of material is conformable such that the layer of material at least partially conforms to a shape of the packaged sanitizing wipe; and a graspable member integral with the layer of material, wherein the graspable member and the package are jointly configured for allowing the layer of material to be at least one of breached and released for permitting access to the packaged sanitizing wipe.

8. The containment article of claim 7 wherein the layer of material is attached only to the bottom wall of the container body.

9. The containment article of claim 7 wherein the container body is a cup configured for having a liquid disposed in the major cavity.

10. The containment article of claim 7 wherein the layer of material is attached only to the bottom wall of the container body.

11. A containment article, comprising:

a cup body made including a first open end, a second open end, a side wall and a bottom wall, wherein a major cavity is defined between the first open end, the side wall and the bottom wall, wherein a minor cavity is defined between the second open end, the side wall and the bottom wall, and wherein the side wall and the bottom wall are jointly configured for allowing a liquid to be contained within the major cavity; and a packaged sanitizing wipe disposed within the minor cavity of the cup body, wherein the packaged sanitizing wipe includes a package having a sanitizing wipe contained within an interior space thereof;

a layer of material extending over the packaged sanitizing wipe and being attached to the cup body such that the layer of material contains the packaged sanitizing wipe within the minor cavity; and a graspable member integral with the layer of material, wherein the graspable member and the package are jointly configured for allowing the layer of material to be at least one of breached and released for permitting access to the packaged sanitizing wine.

12. The containment article of claim 11 wherein the layer of material is attached to the bottom wall of the container body.

13. The containment article of claim 12 wherein the layer of material is conformable such that said material at least partially conforms to a shape of the packaged sanitizing wipe.

14. The containment article of claim 13 wherein the layer of material is attached only to the bottom wall of the cup body.

15. The containment article of claim 11 wherein the cup body is a cup configured for having a liquid disposed in the major cavity.

16. The containment article of claim 11 wherein:

the layer of material is attached to the bottom wall of the cup body; and the layer of material is conformable such that said material at least partially conforms to a shape of the packaged sanitizing wipe.

* * * * *